US008091562B2

(12) United States Patent
Manici et al.

(10) Patent No.: US 8,091,562 B2
(45) Date of Patent: Jan. 10, 2012

(54) COSMETIC PRODUCT APPLICATOR WITH MULTIPLE TYPICALLY ORIENTED ELEMENTS

(75) Inventors: Davide Manici, Brivio (IT); Alain Berhault, Paris (FR)

(73) Assignee: Albea Services (FR)

( * ) Notice: Subject to any disclaimer, the term of this patent is extended or adjusted under 35 U.S.C. 154(b) by 828 days.

(21) Appl. No.: 11/865,784

(22) Filed: Oct. 2, 2007

(65) Prior Publication Data

US 2008/0142034 A1 Jun. 19, 2008

(30) Foreign Application Priority Data

Oct. 9, 2006 (FR) ..... 06 08831

(51) Int. Cl.
*A45D 40/26* (2006.01)

(52) U.S. Cl. ..... 132/218

(58) Field of Classification Search ..... 132/218, 132/308, 317, 320; 15/160, 186, 188, 187, 15/172, 202; D32/25
See application file for complete search history.

(56) References Cited

U.S. PATENT DOCUMENTS

| | | | | |
|---|---|---|---|---|
| 2,496,010 | A * | 1/1950 | Lotters | 15/201 |
| 2,960,712 | A * | 11/1960 | Hayer | 15/179 |
| 3,080,637 | A * | 3/1963 | Dutt | 26/31 |
| 3,968,536 | A * | 7/1976 | Leighton et al. | 15/187 |
| 4,257,434 | A * | 3/1981 | Wahl | 132/118 |
| 4,411,282 | A * | 10/1983 | Wavering | 132/218 |
| 4,422,986 | A | 12/1983 | Cole | |
| 4,527,575 | A * | 7/1985 | Vasas | 132/218 |
| 6,345,626 | B1 * | 2/2002 | Bouix | 132/218 |
| 6,374,450 | B1 * | 4/2002 | Aoyama | 15/167.1 |
| 6,591,842 | B2 * | 7/2003 | Gueret | 132/218 |
| 6,691,716 | B2 * | 2/2004 | Neuner et al. | 132/218 |

FOREIGN PATENT DOCUMENTS

| | | |
|---|---|---|
| EP | 1169940 | 8/2001 |
| WO | 0207560 | 1/2002 |

OTHER PUBLICATIONS

International Search Report, FR 0608831, dated May 15, 2007.

* cited by examiner

*Primary Examiner* — Robyn Doan
(74) *Attorney, Agent, or Firm* — Banner & Witcoff, Ltd.

(57) ABSTRACT

Applicator (1) for a cosmetic product, typically a mascara, comprising an application means (4) having an axial core (40) which is unitary with axial rod (3) at its lower part (31) and a stack (41) of a plurality of N elements which cooperate with axial core (40) through a typically central orifice (50) allowing the axial core (40) to extend therethrough, characterized in that: the elements are elements E (5) lacking complete rotation symmetry, and the axial core (40) and the plurality of elements E (5) operate jointly with an angular orientation means for elements E (5) with respect to axial direction (10), in a transverse plane (11) which is perpendicular to the axial direction (10), in a manner that each element $E_i$ (5) is rotatably connected with axial core (40) and has a predetermined angular orientation $\alpha_i$ with respect to the axial core (40).

28 Claims, 11 Drawing Sheets

COSMETIC PRODUCT APPLICATOR WITH MULTIPLE TYPICALLY ORIENTED ELEMENTS

BACKGROUND OF THE INVENTION (a) Field of the Invention

The invention concerns the field of cosmetic product applicators, typically cosmetic products for eye make-up, such as for example mascaras.

(b) Description of Prior Art

A great number of mascara applicators are already known. These applicators, which are intended to be used with a container defining a reservoir for the mascara, typically comprise:

a) a cap adapted to seal said container and to be used as prehension means for said applicator, b) and axial rod, c) and a brush, said rod being unitary with said cap at one of its ends, and with said brush at its other end, said brush comprising a metallic twist to which a plurality of bristles are fixed.

With respect to said brush, a very large number of embodiments of brushes are already known.

Thus, the brushes described in the following French Patents are known: FR 2 505 633, FR 2 605 505, FR 2 607 372, FR 2 607 373, FR 2 627 068, FR 2 627 363, FR 2 637 471, FR 2 637 472, FR 2 650 162, FR 2 663 826, FR 2 668 905, FR 2 675 355, FR 2 685 859, FR 2 690 318, FR 2 701 198, FR 2 706 749, FR 2 715 038, FR 2 745 481, FR 2 748 913, FR 2 749 489, FR 2 749 490, FR 2 753 614, FR 2 755 593, FR 2 774 269, FR 2 796 531, FR2 796 532, FR2 800 586.

Also known are the brushes described in the following U.S. patents: U.S. Pat. No. 4,733,425, U.S. Pat. No. 4,861,179, U.S. Pat. No. 5,357,987, U.S. Pat. No. 5,595,198, U.S. Pat. No. 6,241,411, U.S. Pat. No. 6,427,700.

Also known are mascara applicators made of a molded member of plastic material, as described for example in the Patent FR 2 868 264 filed by the Applicant.

Also known are applicators comprising a stack of elements in the form of discs, as described for example in Japanese Utility Model No.: 55-172107, and in U.S. Pat. Nos. 6,345,626 and 2002/0059942.

Even though the applicators formed with a molded member of plastic material constitute an advantageous alternative to the use of traditional brushes, they however raise many problems.

Indeed:

on the one hand, injection molding requires the very costly production of injection molds, which can only be justified if one is sure to be able to market large numbers of products, on the other hand, the time required to launch such applicators is very long, taking into account particularly the delay required for producing molds.

There is thus a need to be able to rapidly produce a wide variety of applicators, in particular in view of adapting them to the evolutions of cosmetic product formulations, as well as to the needs expressed by the users, without having to launch the production of costly molds, which are all the more difficult to amortize, that the production series are short and that the life span of the products is short.

SUMMARY OF THE INVENTION

According to the invention, the applicator for a cosmetic product, typically a mascara, comprises:

a) a prehension means typically defining a cap for a container adapted to contain said cosmetic product, b) an axial rod having an axial direction, c) means for applying said cosmetic product, said axial rod being unitary with said prehension means at its upper end, and with said applying means at its lower end.

In this applicator, said applying means comprises an axial core which is unitary with said axial rod at its lower end, and a stack of a plurality of N elements cooperating with said axial core through a typically central orifice allowing said axial core to pass therethrough, said stack being axially fixed to said axial core through an axial assembling means.

It is characterized in that:

1) said elements are elements E which are lacking in total rotational symmetry, 2) said axial core and said plurality of elements E cooperate with a means for angularly orienting said elements E with respect to said axial direction in a transverse plane which is perpendicular to said axial direction, so that each element $E_i$ of rank i in said stack, wherein ranges from 1 to N, is unitary in rotation with said axial core and provides a predetermined angular orientation $\alpha_i$ with respect to said axial core.

This applicator answers the problems raised. Indeed, it allows the manufacturer of applicators, as this will appear still more clearly in the description which follows, to manufacture a very wide variety of applicators which are adapted to various needs, by utilizing a very limited number of elements E. This is made possible by playing around for example with the angular orientation of each element E as a function of its rank i in said stack.

According to a preferred embodiment of the invention, said angular orientation means comprises the cooperation of a plurality of p axial ribs and/or grooves, a plurality of so-called exterior p axial ribs and/or grooves of said axial core cooperating with a plurality of so-called interior complementary p axial ribs and/or grooves formed inside said central orifice of each element $E_i$, said ribs and/or grooves being angularly spaced with respect to said axial direction, by an angle of 360°/p, in a manner that any element $E_i$ of said stack may be oriented according to a distinct angular position $\alpha_{ij}$ selected from the possible p angular positions $\alpha_j$ wherein j ranges from 1 to p. The number of p axial ribs and/or grooves is advantageously higher than or equal to 5 in order to obtain a sufficient number of possible angular orientations, and preferably p varies between 6 and 24.

BRIEF DESCRIPTION OF THE DRAWINGS

All the figures relate to the invention.

FIGS. 1*a* and 1*b* relate to a same element E 5 comprising 12 radial projections 53 which are regularly disposed with respect to the axial direction and which define a plurality of so-called symmetrical projections 54, 54*a*.

FIG. 1*a* is a side view in perspective.

FIG. 1*b* is a view from above.

FIGS. 1*c* and 1*d* relate to a same element E 5 comprising projections 53, 53*b* which are upwardly oriented with respect to a transverse median plane 11 of element E 5, and projections 53, 53*c* which are downwardly oriented with respect to this plane 11.

FIG. 1*c* is a side view.

FIG. 1*d* is a side view in perspective.

FIG. 2*a* is a perspective side view of a portion of applicator 1 in which the applying means 4 comprises 12 identical elements E 5 defining stack 41.

FIG. 2*b* is a perspective view of an element E 5 of stack 41.

FIG. 2*c* is an axial cross-section view of a portion of applicator 1.

FIG. 2*d* is a cross-section along line C-C of FIG. 2*c* in a transverse plane which is perpendicular to axial direction 10.

In FIG. 3*a*, axial core 40 comprises an exterior groove 401, typically an axial groove, which cooperates with an interior rib 500 formed inside the central orifice 50.

In FIG. 3*b*, inversely, axial core 40 comprises an exterior rib 400, typically an axial rib, which cooperates with an interior groove 501 formed inside central orifice 50.

In FIG. 3*c*, the axial core 40 comprises a series of exterior ribs 400 and grooves 401 which cooperate with a series of interior grooves 501 and ribs 500 formed inside the central orifice 50 of each element E 5.

FIG. 4*a* is an axial cross-section view of a portion of applicator 1 comprising a stack 41 of 22 elements 5.

FIG. 4*b* is a partial transverse cross-section taken along transverse plane A-A of FIG. 4*a*.

FIG. 4*c* is a view of a cross-section of an element 5 taken along an axial plane.

FIG. 4*d* is a partial transverse cross-section of element 5 of FIG. 4*c* taken along transverse plane C-C of FIG. 4*c*.

FIG. 4*e* is an axial cross-section view of core 40,40*a* which is unitary with rod 3 at its lower end 31.

FIG. 4*f* is a transverse cross-section of the core 40,40*a* of FIG. 4*e* taken along the transverse plane E-E of FIG. 4*e*, which illustrates the case where each element E 5 may take any one of 8 distinct angular positions α.

FIG. 5*a* is an axial cross-section of an element E 5 in which the peripheral part 52 is inclined while forming an angle β, which is different than 90°, with axial direction 10, in a manner to define a stack 41 including a plurality of so-called inclined 54*c* projections 54.

FIG. 5*b* is a view from above of the element E 5 of FIG. 5*a*.

FIG. 5*c*, which is similar to FIG. 5*b*, represents an element E 5 in which one of the radial projections 53 is a typically rigid radial projection 53*e* in a manner to define a comb tooth, the other projections being flexible projections 53*d*.

FIG. 5*d* represents a partial axial cross-section of a stack of two elements E 5 of FIG. 5*c* taken along axial plane C-C of FIG. 5*c*.

FIG. 5*e* is a schematic representation of the case where the rigid projections 53*e*, represented by their extremity, define an axial alignment, all the elements E 5 being stacked over one another with the same angular orientation.

FIG. 5*f*, which is similar to FIG. 5*e*, represents the case where the rigid projections 53*e*, represented by their extremity, define a helix, all the elements E 5 being stacked over one another with an angular increment of an angle α corresponding to an angle having 360° /p.

FIG. 6*a* is similar to FIG. 4*a*.

FIG. 6*b* represents an axial cross-section of the sub-assembly formed by assembling stack 41 over axial core 40*b*, before assembling it on rod 3.

FIG. 6*c* represents an axial cross-section, of the lower end 31 of rod 3 comprising a blind hole 32 at its lower end, adapted for assembling it with the sub-assembly of FIG. 6*b*.

FIG. 6*d* is an axial cross-section of axial core 40*b*, this core comprising a lower end 43,43*b* having a transverse cross-section which is typically related to central part C 51, so that, as indicated by an arrow, the stack 41 must be assembled on core 40*b* by slipping over the elements E 5 through the upper part defining the handle member 44.

FIG. 6*e* represents an axial cross-section of stack 41 opposite axial core 40*b* immediately before assembling same over core 40*b*.

FIG. 7*a* represents an axial cross-section of an element E 5 in which the peripheral part 52 is inclined by an angle β, each radial projection 53 typically having a base or heel 530 having an axial height which is shorter than height $E_c$ of central part 51.

FIGS. 7*b* and 7*c*, which are similar, represent two types of stack portions 41 made of 3 elements E 5.

In FIG. 7*b*, stack 41 is a regular stack 41*a* made of identical elements E 5, while on FIG. 7*c*, in alternation, an element E 5 has been rotated 180° so as to constitute an alternating stack 41*b* defining a completely different application means.

FIG. 8*a* is a view from above.

FIG. 8*b* is an axial cross-section.

FIG. 8*c* is a side view.

FIG. 8*d* represents a view of the end 531 of a radial projection 53.

FIG. 8*e* is a side view of a portion of a stack 41 of 2 elements 5, one having been rotated 45° with respect to the other one.

DESCRIPTION OF PREFERRED EMBODIMENTS

Figure 1A:
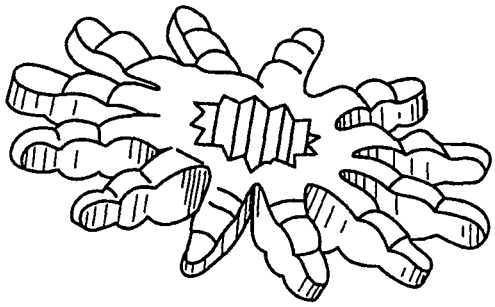
FIGS. 1*a* to 1*d* are views concerning elements E 5 of stack 41 of applying means 4 for applicator 1.

According to the invention, the angular orientation means may comprise the cooperation of a plurality of p ribs and/or axial grooves, a plurality of so called external axial p ribs 400 and/or grooves 401 of axial core 40 cooperating with a plurality of so called internal additional axial p ribs 500 and/or grooves 501 formed inside the central orifice 50 of each element $E_i$ 5, the ribs and/or grooves being angularly spaced with respect to axial direction 10 by an angle of 360°/p, in a manner that any element $E_i$ 5 of stack 41 could be oriented according to a distinct angular position $\alpha_{ij}$ selected from the possible p angular positions $\alpha_j$, wherein j varies from 1 to p.

Coupling of each element 5 with axial core 40 by rotation has been illustrated particularly in FIGS. 3*a* to 3*c* and 4*b*.

The number p of axial ribs and/or grooves is advantageously higher than or equal to 5 in order to obtain a sufficient number of possible angular orientations. Number p preferably varies between 6 and 24, and more particularly between 10 and 18.

Figure 1B:
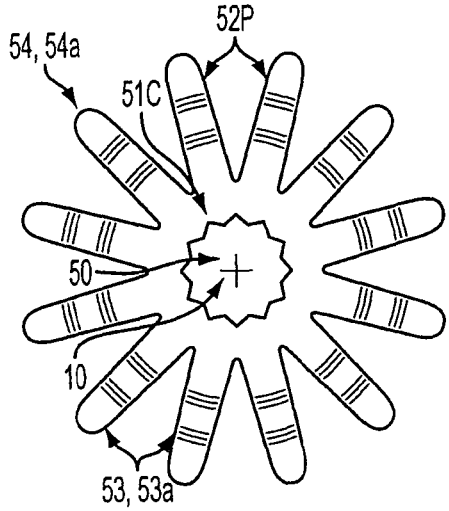
Figure 1C:
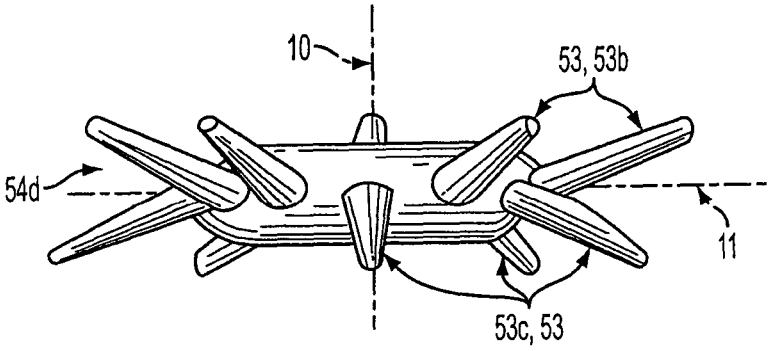
Figure 1D:
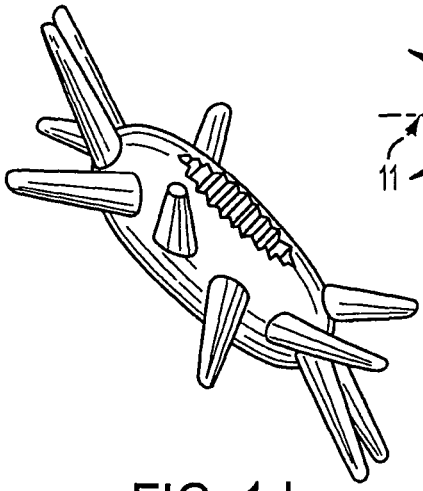
Figure 1E:
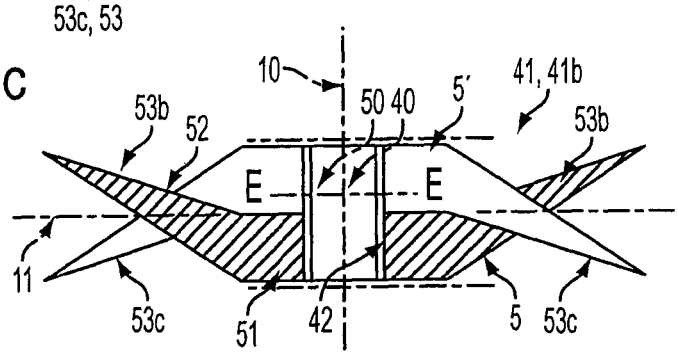
FIG. 1*e* illustrates an inter-crossing of projections 53 of two consecutive elements 5 and 5' of a portion of stack 41, the projections 53*c* of element 5' represented in dotted line being downwardly oriented and angularly offset with respect to projections 53*b* which are upwardly oriented towards the element 5 illustrated by a hatched surface.
Figure 2A:
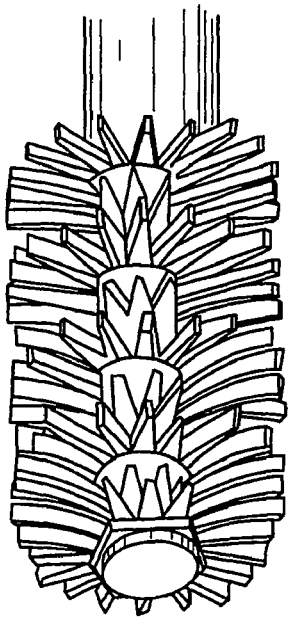
FIGS. 2*a* to 2*d* illustrate another embodiment of the invention.
Figure 2B:
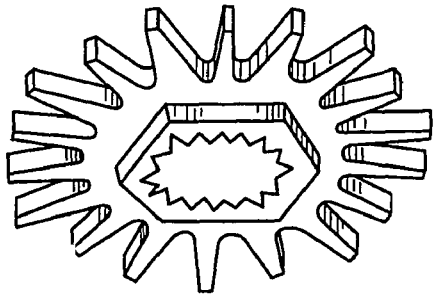
Figure 2D:
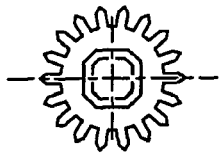
Figure 2C:
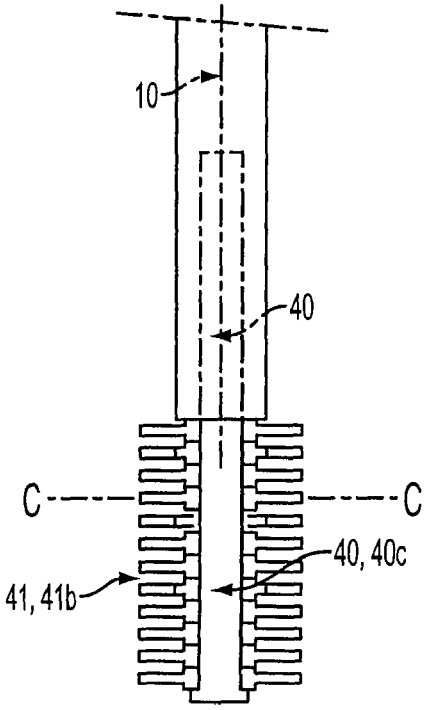
Figure 3A:
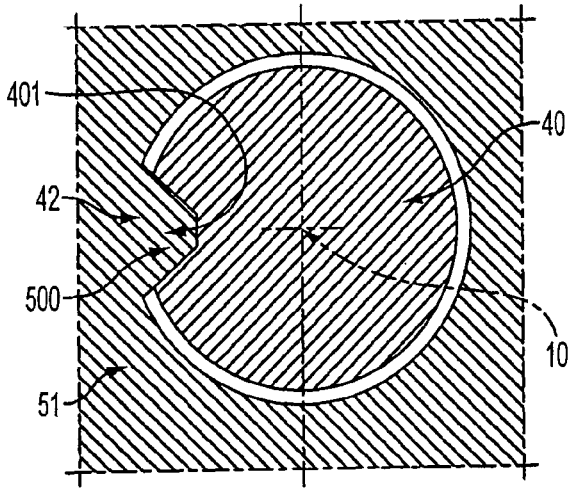
FIGS. 3*a* to 3*c* are partial transverse cross-sections taken along transverse plane E-E of FIG. 1*e* which illustrate 3 embodiments of angular orientation means 42 of an element E 5 with respect to axial core 40.
Figure 3B:
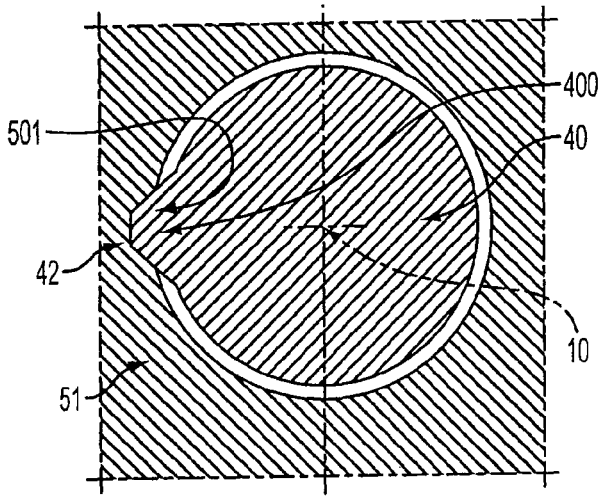
Figure 3C:
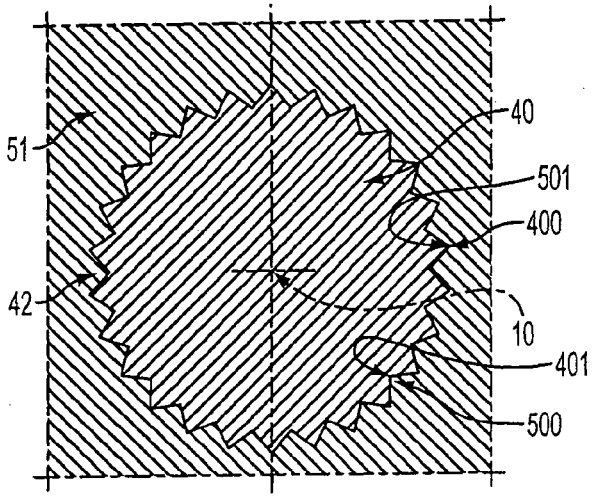
Figure 4A:
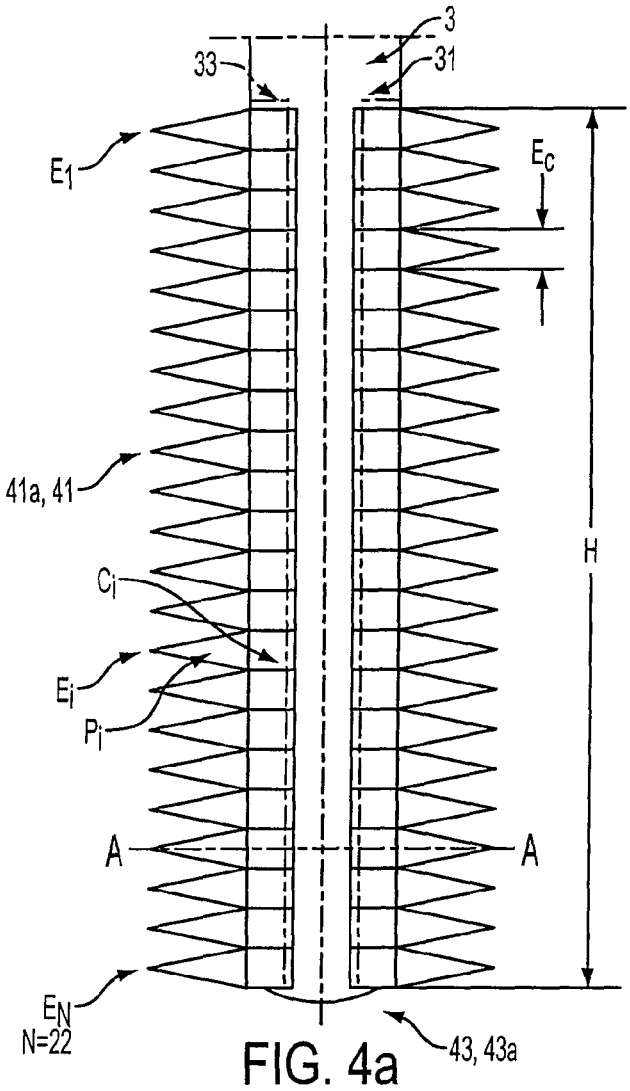
FIGS. 4*a* to 4*f* illustrate the case where core 40 is a core 40*a* defining a single-piece member with rod 3, core 40*a* having an end 43, 43*a* defining a flexible peripheral part 430*a* allowing to assemble stack 41 on core 40*a* by means of an axial snap.
Figure 4E:
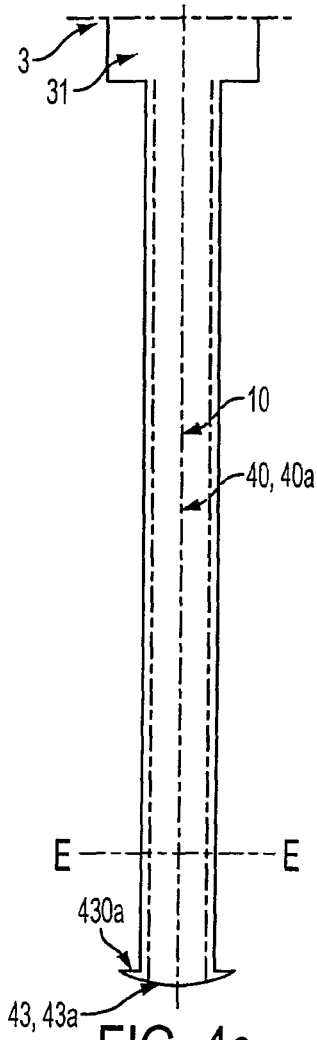
Figure 4B:
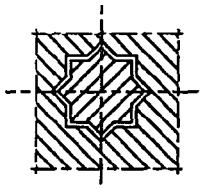
Figure 4F:
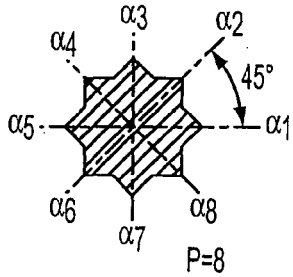
Figure 4D:
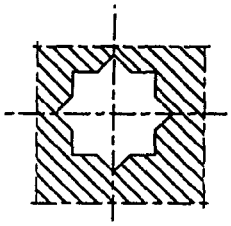
Figure 4C:
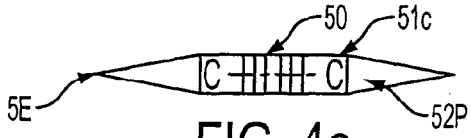

As illustrated for example in FIGS. 1*e* and 4*c*, the element $E_i$ 5 of the stack may comprise a central part C 51, identified $C_i$, typically an annular central part, which is operatively connected with axial core 40, in a manner to define the axial assembling means and the angular orientation means, and a peripheral part P 52 identified as $P_i$ adapted for allowing a sampling of a portion of the cosmetic product.

Typically, all the elements E±5 of stack 41 may comprise a same central part $C_i$ 51 and a same peripheral part $P_i$ 52. Indeed, axial core 40 generally has a transverse cross-section that is constant along its entire height.

According to an embodiment of the invention, all the elements $E_i$ of stack 41 may comprise a same central part $C_i$ 51, at least two elements E 5 of stack 41 having a peripheral part P 52 which differs in its intrinsic shape and/or its angular orientation.

Figure 5A:
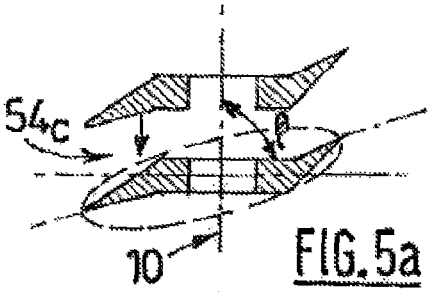
FIGS. 5*a* to 5*f* illustrate other embodiments of the invention.
Figure 5G:
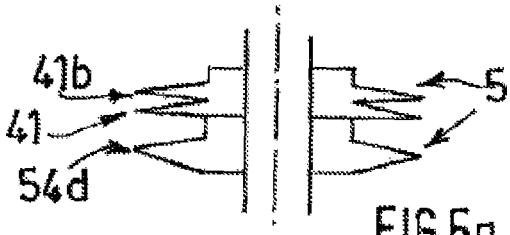
FIG. 5*g* represents an axial cross-section of a portion of a stack 41 comprising an alternation of two different elements E 5.
Figure 5B:
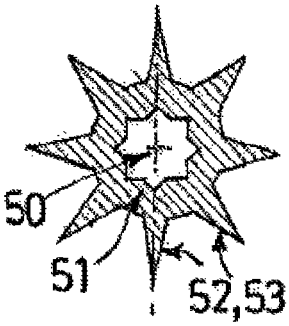
Figure 5H:
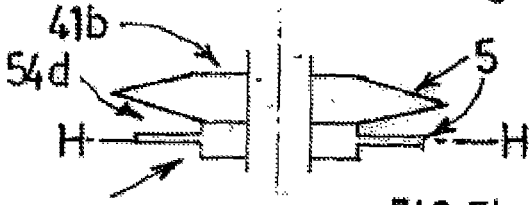
FIG. 5*h*, which is similar to FIG. 5*g*, corresponds to a different embodiment according to which one of the elements E 5 comprises a peripheral portion 52 comprising a plurality of hollowed portions 534.

However, as illustrated in FIGS. 5*g* and 5*h*, at least two elements E 5 of stack 41 may comprise neither a same central part C 51, nor a same peripheral part P 52.

According to another embodiment of the invention, stack 41 may be formed by an alternation of elements 5 $E_1$ and $E_2$ which are distinct from one another through central part C 51 and/or peripheral part P 52.

As illustrated for example in FIGS. 1*b*, 5*b*, peripheral part P 52 of element E 5 may comprise or constitute a plurality of n radial projections 53, which are typically regularly angularly spaced according to the axial direction through an angle equal to 360°/n.

The number n of radial projections may be identical to the number p of distinct angular positions, this number n ranging from 6 to 24, preferably from 10 to 18.

As illustrated in FIG. 1*b*, the plurality 54 of radial projections 53 may be a so-called symmetrical plurality 54*a*, the n radial projections 53 being all identical, element E 5 having a rotational symmetry of the n order.

Figure 5C:
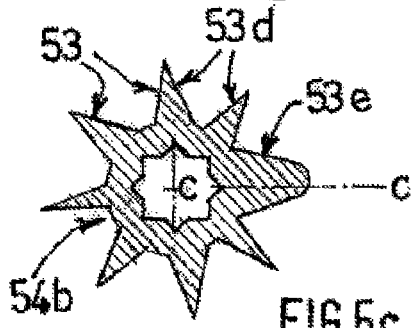

As illustrated in FIG. 5*c*, the plurality 54 may be a so-called non symmetrical plurality 54*b*, the n radial projections 53 not being all identical so that element E 5 does not have a rotational symmetry of the n order.

As illustrated in FIGS. 5*a* and 5*b*, the plurality 54 may be a so-called inclined plurality 54*c*, at least one of the n radial projections 53 of the peripheral part 52 of element 5 being disposed or oriented outside transverse plane 11 by defining an angle β which is different than 90° and varies between 60° and 120°.

As illustrated in FIGS. 1*c* and 1*d*, at least part of the plurality (54) of n radial projections 53 of the peripheral part 52 of element E 5 may constitute an alternation of radial projections (53), one projection defining with the axial direction an angle higher than 90° and which is typically between 90° and 120°, the adjacent projection defining with the axial direction an angle smaller than 90° and which is typically between 60° and 90°, so as to constitute a so-called alternating plurality 54*d*.

As illustrated in FIGS. 8*a* to 8*e*, the plurality of n radial projections 53 of peripheral part 52 of element E 5 may be a so-called axial plurality 54*e*, radial projections 53 having a relatively small thickness in an axial plane comprising the axial direction 10.

According to the invention, the number N of elements $E_i$ may range from 8 to 30, and typically from 12 to 24.

As illustrated in FIG. 4*a*, the stack 41 may have a height H which typically varies from 10 mm to 50 mm, height H corresponding to the sum of the axial thicknesses $E_c$ of the central parts $C_i$ 51, the height H being equal to the product $N.E_c$ when the central parts $C_i$ 51 have identical axial thicknesses $E_c$.

At least one radial projection of the plurality of projections may be a flexible projection 53*d*, flexible projection 53*d* having either an axial and/or transverse thickness which gradually decreases from its base to constitute a junction with the central surface part up to its extremity that is the most remote from the axial direction, or a thinned down part defining a hinge.

Figure 8A:
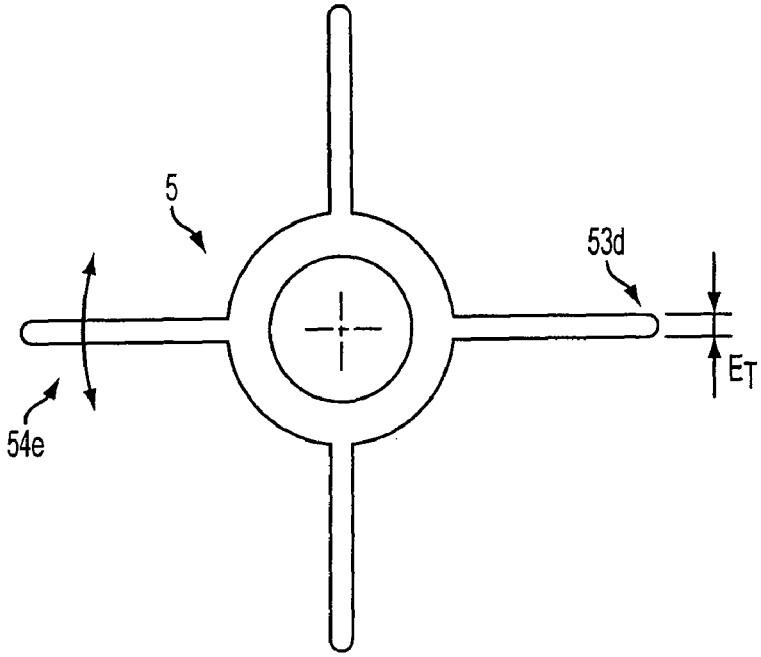
FIGS. 8*a* to 8*e* illustrate another embodiment of element E 5 according to the invention, comprising a so-called axial plurality 54*e* of radial projections 53 of small thickness in an axial plane.
Figure 8B:
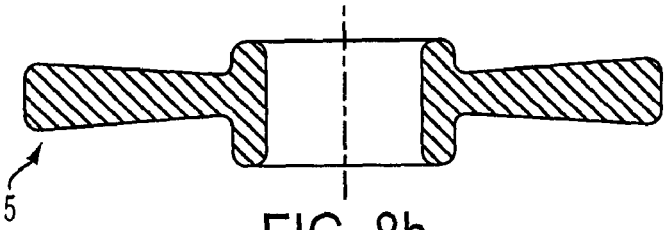
Figure 8C:
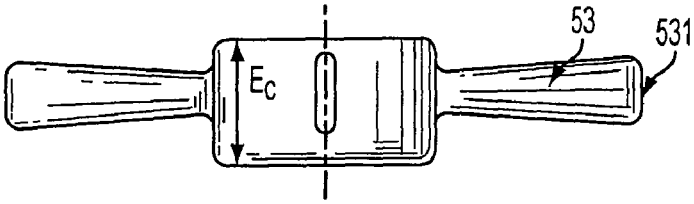
Figure 8D:
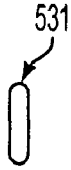
Figure 8E:
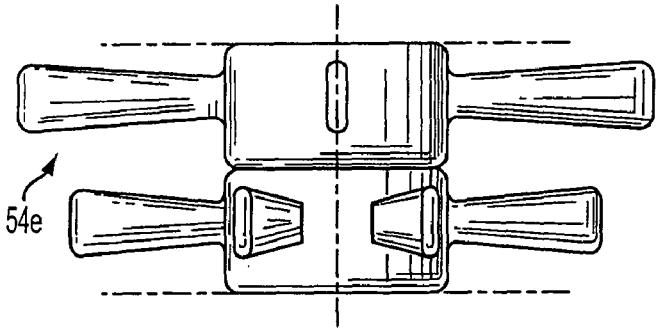

The flexible projection 53*d* may be a flexible transverse projection. Its transverse thickness $E_T$ typically gradually decreases from its base 530 to define a junction with central part 51 up to its extremity 531 that is most remote from axial direction 10. Its axial thickness $E_A$ possibly remains constant. However, as illustrated in FIG. 8*a*, this thickness $E_T$ may remain substantially constant along the entire radial length of the projection as long as it is sufficiently small to ensure a sufficient flexibility to the radial projection 53.

Figure 7A:
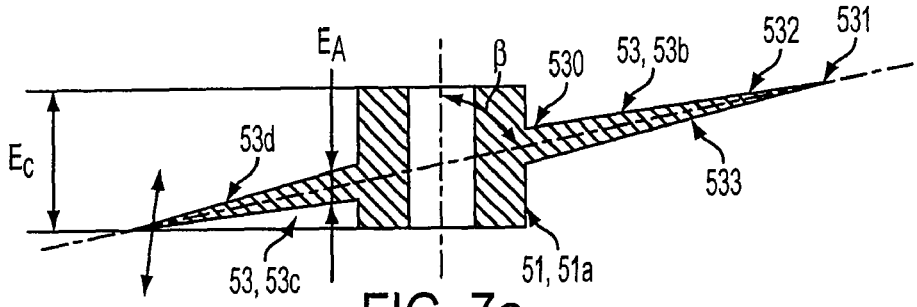
FIGS. 7*a* to 7*c* illustrate other embodiments of elements E 5 according to the invention.

As illustrated in FIG. 7*a*, flexible projection 53*d* is an axially flexible projection, its axial thickness $E_A$ gradually decreasing from its base 530 to constitute a junction with said central part 51 up to its extremity 531 that is most remote from axial direction 10, its transverse thickness $E_T$ possibly remaining constant.

Figure 5I:
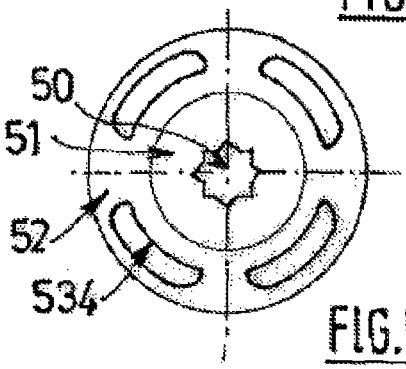
FIG. 5*i* is a transverse cross-section H-H of an element 5 of FIG. 5*h*.
Figure 5D:
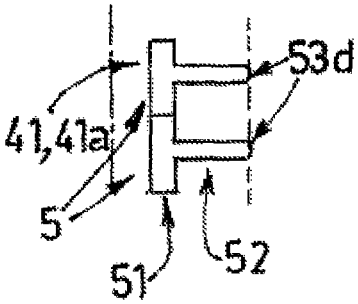
Figure 5E:
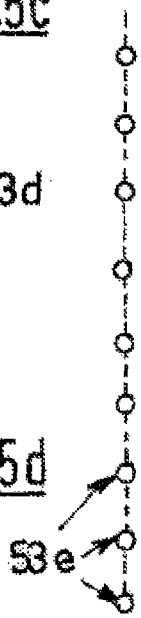
Figure 5F:
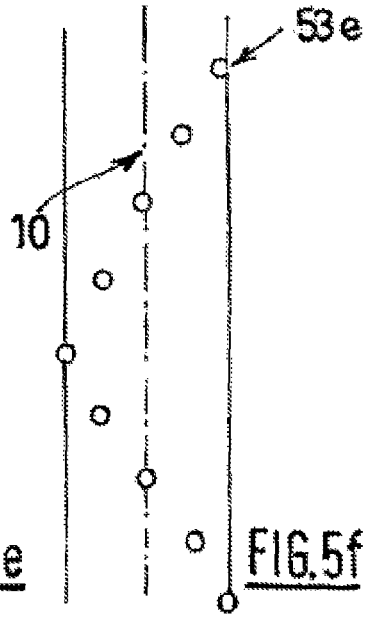
Figure 6A:
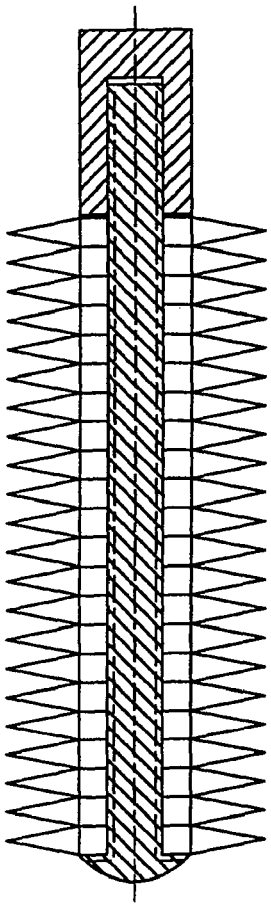
FIGS. 6*a* to 6*e* illustrate an embodiment of applicator which is different from the one illustrated in FIGS. 4*a* to 4*f*. In this embodiment, the axial core 40 is an axial core 40*b* comprising an upper part defining a handle member 44 coupling with rod 3, rod 3 comprising a blind hole 32 at its lower end to achieve the above coupling.
Figure 6C:
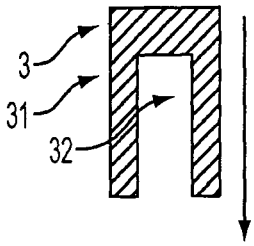
Figure 6E:
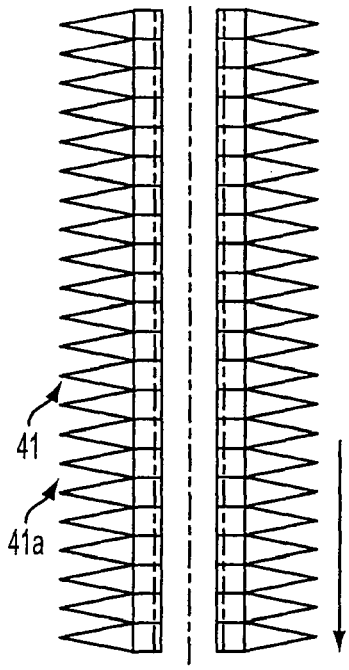
Figure 6B:
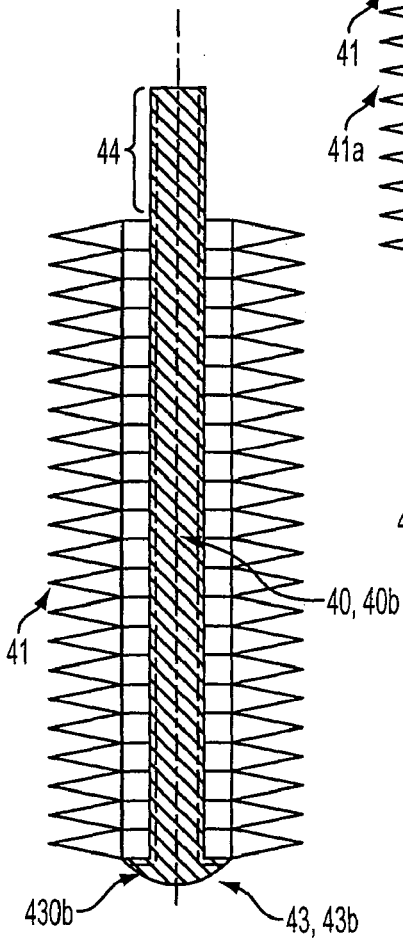
Figure 6D:
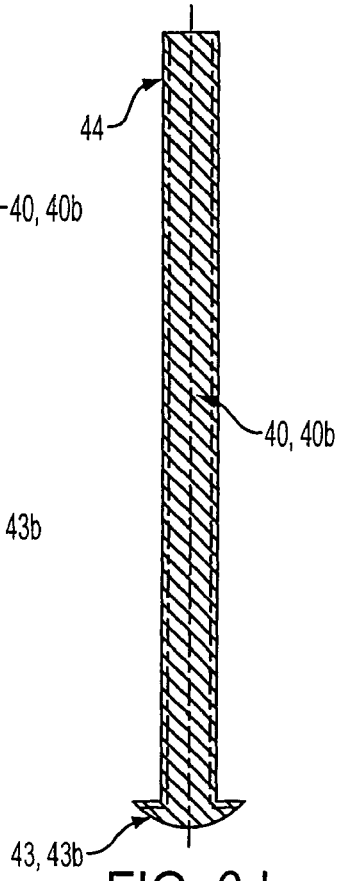

As illustrated in FIG. 5*i*, the radial projection 53 may comprise, typically along is upper 532 and/or lower 533 axial surface, at least one hollowed part 534, so as to increase the holding capacity of application means 4 for the cosmetic product, and/or to increase the flexibility of the axial projection 53.

According to the invention, elements E 5 may be articles of plastic material formed by molding or by machining.

As illustrated in FIGS. 4*a* to 4*f*, axial core 40 and axial rod 3 may constitute a molded member of plastic material, which is typically rigid, the junction between the rod and the axial core defining a shoulder 33 constituting a so-called upper abutment for the first element $E_1$ 5 of stack 41, so as to define an upper part of the axial assembling means. This molded member of plastic material is typically a single-piece member.

In this case, the axial core 40 may be provided at its lower end 43 with a so-called lower abutment for the last element $E_N$ 5, the lower abutment typically comprising a radial member 43*a* allowing an axial irreversible snapping of stack 41 on axial core 40, so as to define a lower part of the axial assembling means.

According to another embodiment, and as illustrated in FIGS. 6*a* to 6*e*, the axial core 40 may comprise a coupling handle member 44 at its upper part, the coupling handle member cooperating with a blind hole 32 of axial rod 3 at its lower end 31, axial core 40 forming at its lower end 43 a so-called lower abutment for the last element $E_N$ 5, the lower abutment typically comprising a radial member 43*b* defining a lower abutment or stop for stack 41.

Figure 7B:
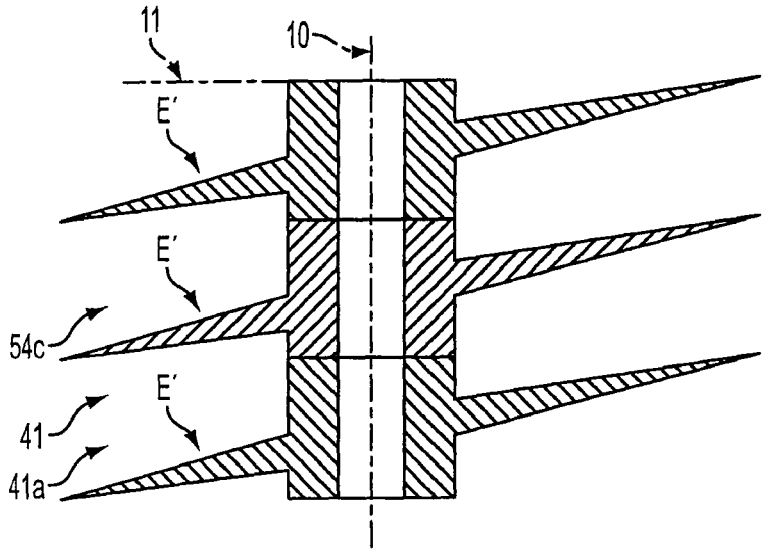
Figure 7C:
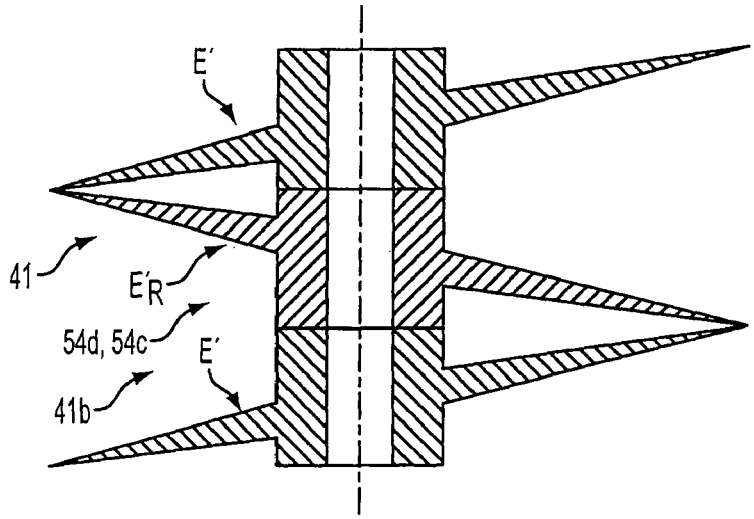

As illustrated in FIGS. 7*a* to 7*c*, element E 5 may be a so-called asymmetrical element E', because of a lack of symmetry with respect to a transverse plane, so that a turning around of element E' with respect to the axial direction leads to an element E'R which is not superposable over element E', in a manner to thus constitute, from a same element E', a large number of distinct applicators.

Indeed, by way of example, the stack portion of FIG. 7*b* may be written E'-E'-E while the stack portion of FIG. 7*c* may be written E'-$E'_R$-E'. It is consequently possible to obtain a very large number of distinct arrangements by combining elements E' and $E'_R$.

Stack 41 may be a stack 41' in which two consecutive elements (5) are separated by an intermediate member I 8, intermediate member I 8 having a transverse cross-section that is typically closely related to the transverse cross-section of central part 51 of elements 5.

This intermediate member 8 is an insert member that is disposed between two consecutive elements $E_i$ and $E_{i+1}$. This intermediate member 8 may be an axially compressible member.

Figure 11:
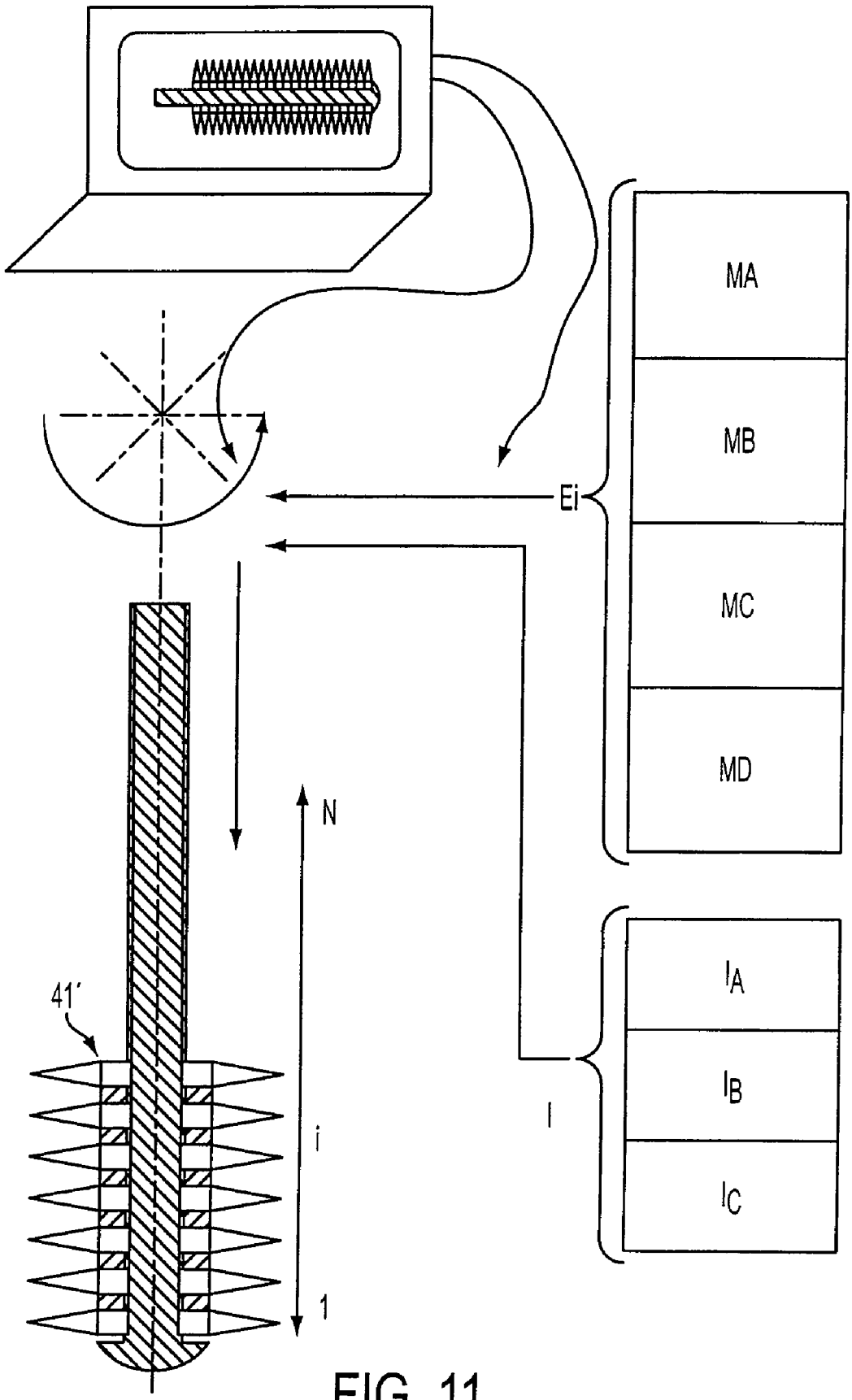
FIG. 11, which is similar to FIG. 10, illustrates the case in which stack 41 is a stack 41' in which two consecutive elements 5 are separated by an intermediate member I 8 which may be selected among many types ($I_A$, $I_B$, $I_C$).

As illustrated in FIG. 11, various types of intermediate members 8 may be used.

Another object of the invention is provided by the process of manufacturing an applicator 1 according to the invention.

In this process:

1) there is provided or produced by plastic material molding, at least one model M of element E 5, and typically a plurality of models $M_k$ of elements E 5, wherein k typically varies from 1 to 10, and possibly at least one model of intermediate member I 8,
2) there is provided or produced by plastic material molding, a molded member comprising axial core 40 and possibly the axial rod,
3) stack 41 of the plurality of N elements E 5 is produced, each element $E_i$ of rank i in the stack being selected with respect to model $M_{ik}$ selected for rank i among the k models M, with respect to its distinct angular orientation $\alpha_{ij}$ selected among the p possible angular orientations $\alpha_{ij}$, and possibly with respect to its orientation in the case of a so-called asymmetrical element $E'_i$.

The stack 41 of the plurality of N elements E 5 may be formed before being fixedly mounted on axial core 40.

The stack 41 may be prepared automatically and at high rate through a device 7 allowing to simultaneously produce from 10 to 100 stacks per minute, device (7) comprising a supply of the k models M, with means for selecting, for element $E_i$ of rank i of the stack, the predetermined model $M_{ik}$ and for orienting same according to predetermined angular orientation $\alpha_{ij}$, stack (41) being either directly produced on axial core 40, or before being assembled with axial core 40.

Figure 10:
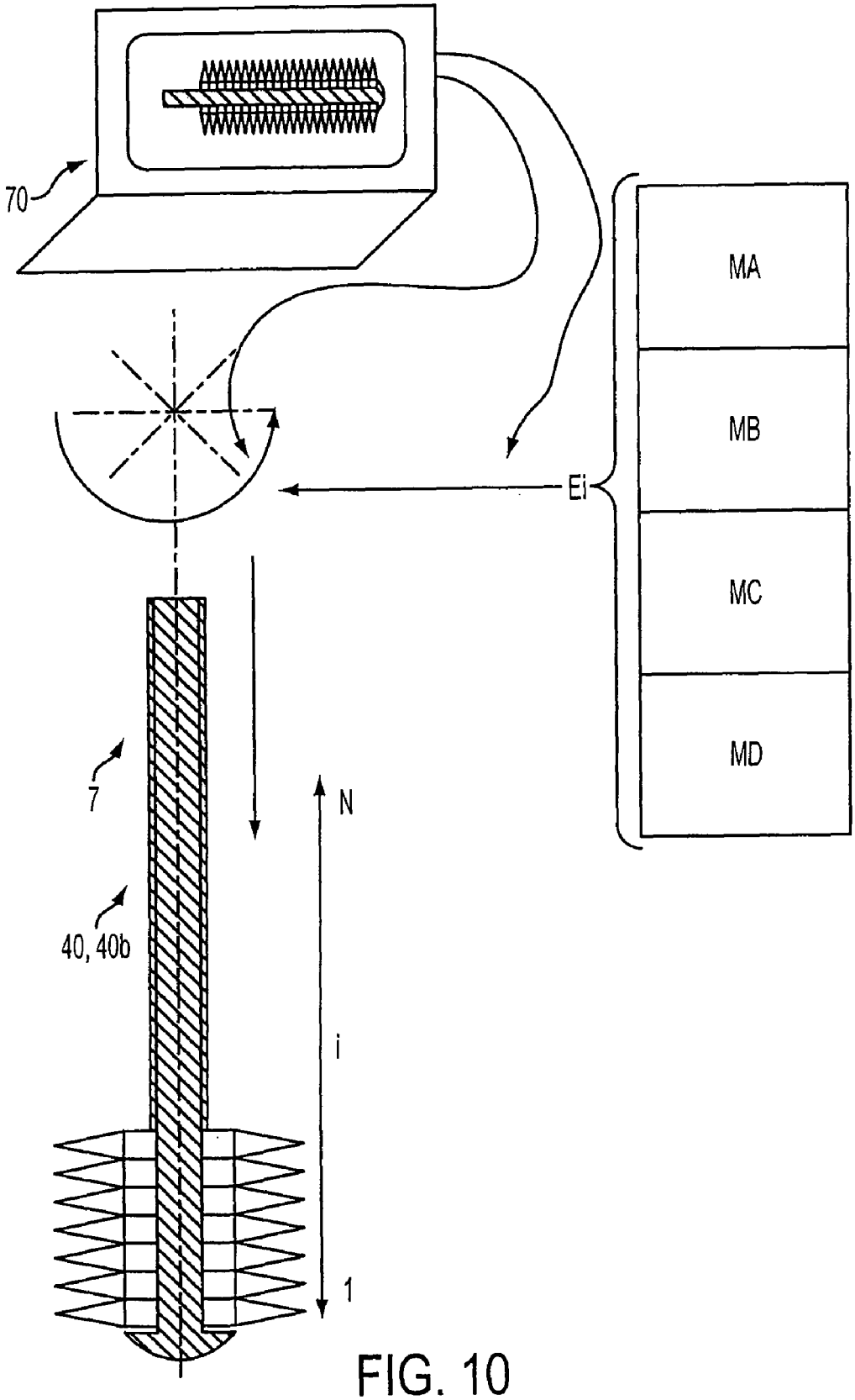
FIG. 10 is a partial schematic representation of a device 7 for the automatic production of applicators 1 according to the embodiment of FIGS. 6*a* to 6*e*. According to this process the structure of stack 41 is stored in a computer, each element $E_i$ or rank i of this stack being defined by its nature or its model, the latter to be selected, as illustrated by way of example among 4 models identified $M_A$ to $M_D$, and by its own orientation $\alpha_i$. As schematically illustrated in this figure, the element $E_i$ is first selected, after which, it is oriented before being slipped over said core 40,40*a*,40*b*. According to a variant of this process, stack 41 could first be formed, after which it could be mounted as a whole on core 40,40*a*,40*b*.

As illustrated in FIG. 10, device 7 comprises a control device 70 typically comprising a computer memory adapted for storing information with respect to stack 41, each element $E_i$ of stack 41 being defined in particular by the type of model $M_k$ and its angular orientation $\alpha_j$.

Another object of the invention is an applicator dispenser 6 comprising an applicator 1 according to the invention, or obtained by the process according to the invention, and a body 60 defining a container for the cosmetic product, the body 60 comprising a neck 61 typically provided with a wiper 62 for the application means, the prehension means 2 of applicator 1 defining a cap 2' adapted to cooperate by screwing with neck 61 so as to seal same.

Figure 9A:
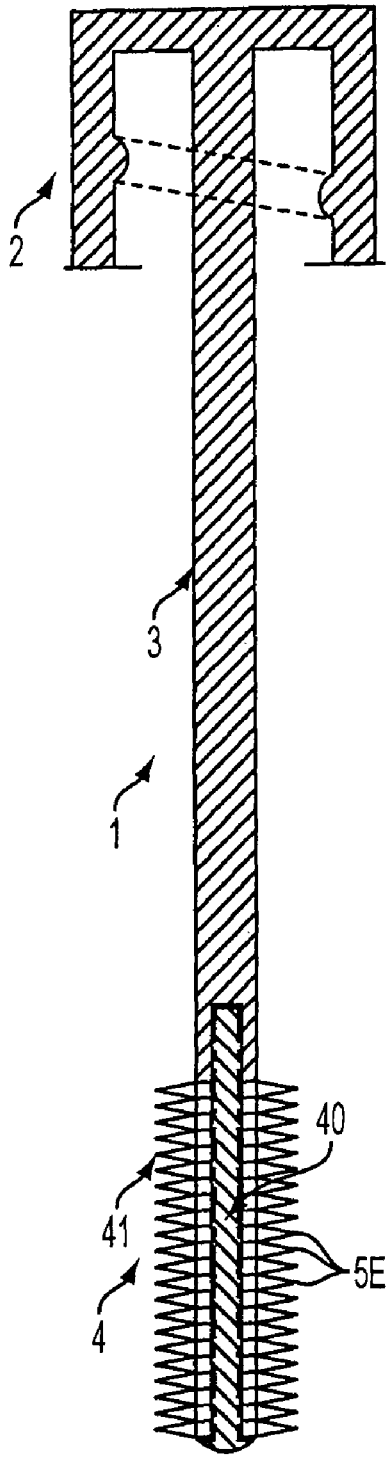
FIGS. 9*a* and 9*b* represent an axial cross-section, respectively of an applicator 1 according to the invention, and a dispenser applicator 6 which comprises the applicator 1 of FIG. 9*a*.
Figure 9B:
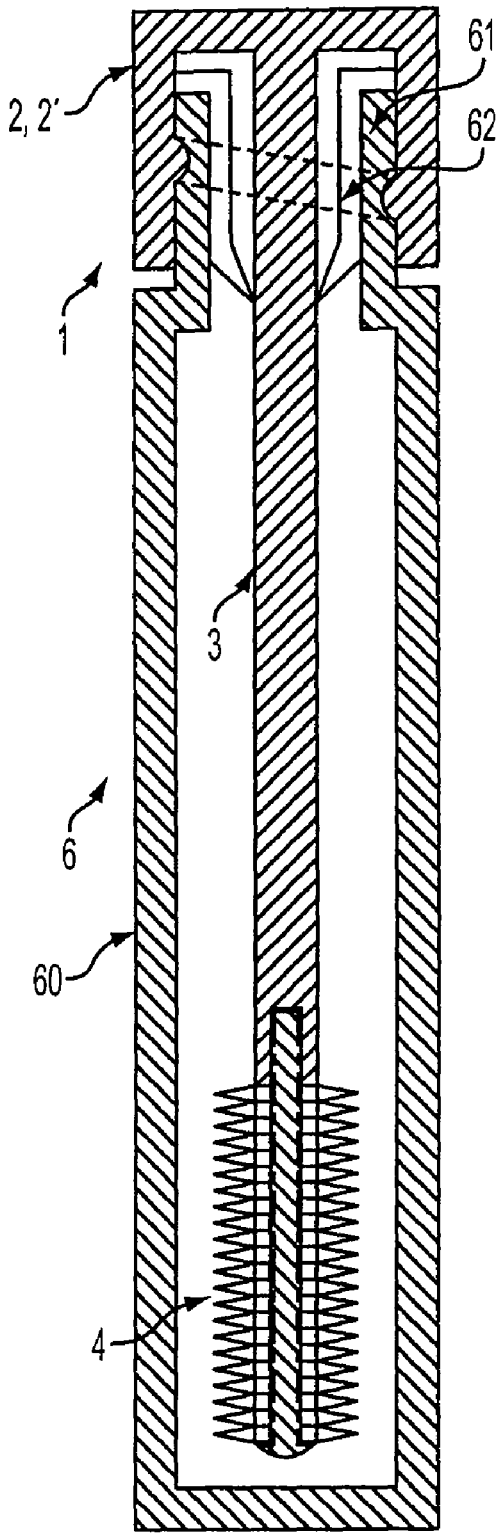

Such a dispenser applicator 6 has been illustrated in FIG. 9*b*.

Another object of the invention consists of an applicator assembly comprising an applicator 1 according to the invention, or obtained by the process of the invention, and at least another plurality of elements E', the means for axially assembling the applicator 1 comprising the stack of elements E 40, being a reversible axially assembling means, so as to permit replacement of at least part of stack E 40 by at least part of stack E' 40', stack E' 40' being distinct from stack E 40.

Thus, in particular, any user will have the choice of adapting the shape of his brush to his present needs.

EXAMPLES

All the figures constitute examples of preferred embodiments.

Elements E 5 were molded with PE or PP, as well as with an elastomer.

ADVANTAGES OF THE INVENTION

In view of the forever increasing requests for all kinds of applicators, the invention allows the industrial production of a large variety of applicators in a manner to comply with the needs of the users of cosmetic products.

In view of the need to rapidly comply with any request, the invention constitutes an industrial answer, bearing in mind the possibility of producing the applicators of the invention at high rate, and even in the case of the production of a limited number of applicators.

LIST OF REFERENCE MARKS

| | |
|---|---|
| Applicator | 1 |
| Axial direction | 10 |
| Transverse plane perpendicular to 10 | 11 |
| Prehension means | 2 |
| Cap | 2' |
| Axial rod | 3 |
| Upper part | 30 |
| Lower part | 31 |
| Blind hole cooperating with 44 | 32 |
| Shoulder defining abutment | 33 |
| Means of application | 4 |
| Axial rod | 40, 40a, 40b |
| Exterior axial rib | 400 |
| Exterior axial groove | 401 |

-continued

| LIST OF REFERENCE MARKS | |
|---|---|
| Stack of elements E, E' | 41, 41' |
| Stack of identical elements E | 41a |
| Stack of different elements E | 41b |
| Means for angular orientation of 40-41 | 42 |
| Lower end of 40 | 43, 43a, 43b |
| Handle member for coupling 40 to 3 | 44 |
| Element E | 5 |
| Central orifice | 50 |
| Interior axial rib | 500 |
| Interior axial groove | 501 |
| Central part C | 51, 51a |
| Peripheral part P | 52 |
| Radial projection of 52 | 53 |
| Projection oriented according to 11 | 53a |
| Projection oriented towards top of 11 | 53b |
| Projection oriented towards bottom of 11 | 53c |
| Flexible projection | 53d |
| Rigid projection | 53e |
| Base of 53 | 530 |
| End of 53 | 531 |
| Upper axial surface | 532 |
| Lower axial surface | 533 |
| Hollowed part | 534 |
| Plurality of projections 53 | 54 |
| Symmetrical plurality | 54a |
| Non symmetrical plurality | 54b |
| Inclined part | 54c |
| Alternated plurality | 54d |
| Axial plurality | 54e |
| Dispenser applicator | 6 |
| Body of 6 | 60 |
| Neck of 60 | 61 |
| Wiper | 62 |
| Automatic device | 7 |
| Control device | 70 |
| Insert member I | 8 |

The invention claimed is:

1. Applicator for a cosmetic product comprising:

a) a prehension means defining a cap for a container adapted to contain said cosmetic product, b) an axial rod, c) means for applying said cosmetic product, said axial rod being unitary with said prehension means at its upper end, and with said applying means at its lower end, in which said applying means comprises:

(i) an axial core which is unitary with said axial rod at its lower end, and (ii) a stack of a plurality of N elements E, each element being a molded or machined single piece of material and comprising a central orifice for housing said axial core allowing said axial core to pass therethrough and at least a projection, said stack being axially fixed to said axial core through an axial assembling means, wherein said axial core and said plurality of elements E cooperate with a means for angularly orienting said elements E with respect to said axial rod in a transverse plane perpendicular to said axial rod, so that each element $E_i$ of rank i in said stack, wherein i ranges from 1 to N, is unitary in rotation with said axial core and provides a predetermined angular orientation $\alpha_i$ with respect to said axial core;

wherein each element $E_i$ of said stack comprises a central part C, identified $C_i$, which is operatively connected to said axial core, in a manner to define said axial assembling means and said angular orientation means, and a peripheral part P identified as $P_i$ adapted for allowing a sampling of a portion of said cosmetic product;

wherein at least two elements E of said stack comprise neither a same central part C nor a same peripheral part P.

2. Applicator according to claim 1 in which said angular orientation means includes a plurality of external axial p ribs and/or grooves of said axial core, complimentary in shape and configured to engage with a plurality of internal axial p ribs and/or grooves formed inside said central orifice of each element $E_i$, the external and internal ribs and/or grooves being angularly spaced with respect to said axial direction by an angle of 360°/p in a manner that any element $E_i$ of said stack can be oriented according to a distinct angular position $\alpha_{ij}$ selected from the possible p angular positions $\alpha_j$ wherein j varies from 1 to p.

3. Applicator according to claim 2 in which the number p of possible angular positions is higher than or equal to 5.

4. Applicator according to claim 3 in which the number p of possible angular positions between 10 and 18.

5. Applicator according to claim 1 in which said stack is formed by an alternating arrangement of elements $E_1$ and $E_2$, elements $E_1$ and $E_2$ each having one of distinct central parts C and distinct peripheral parts P.

6. Applicator according to claim 1 in which said peripheral part P of at least one element E comprises a plurality of n radial projections regularly angularly spaced according to said axial direction through an angle equal to 360°/n.

7. Applicator according to claim 6 in which the number n of radial projections is identical to the number p of distinct angular positions, n ranging from 10 to 18.

8. Applicator according to claim 6 in which said plurality of radial projections is a symmetrical plurality, said n radial projections being all identical, said at least one element E having rotational symmetry of the n order.

9. Applicator according to claim 6 in which said plurality is a non symmetrical plurality, said n radial projections not being all identical so that said at least one element E does not have rotational symmetry of the order of n.

10. Applicator according to claim 6 in which said plurality is an inclined plurality, at least one of the n radial projections of said peripheral part of said element being disposed or oriented outside said transverse plane by defining an angle β which is different than 90° and varies from 60° to 120°.

11. Applicator according to claim 6 in which at least part of said plurality of n radial projections of said peripheral part of said at least one element E includes alternating radial projections, one projection defining with said axial rod an angle between 90° and 120°, the adjacent projection defining with said axial rod an angle between 60° and 90°.

12. Applicator according to claim 6 in which said plurality of n radial projections of said peripheral part of said at least one element E is an axial plurality, said radial projections having decreasing thickness moving in the axial direction.

13. Applicator according to claim 6 in which at least one radial projection of said plurality of projections is a flexible projection, said flexible projection having either an axial or transverse thickness which gradually decreases from its base to constitute a junction with said central surface part up to its extremity that is the most remote from said axial direction.

14. Applicator according to claim 13 in which said flexible projection is a flexible transverse projection, the transverse thickness $E_T$ of the flexible transverse projection gradually decreasing from its base to define a junction with said central part up to its extremity that is most remote from said axial direction, its axial thickness $E_A$ remaining constant.

15. Applicator according to claim 14 in which said flexible projection is an axially flexible projection, its axial thickness $E_A$ gradually decreasing from its base to constitute a junction with said central part up to its extremity that is most remote from said axial direction, its transverse thickness $E_T$ remaining constant.

16. Applicator according to claim 6 in which said radial projection comprises, along is upper and/or lower axial surface, at least one hollowed part, so as to increase the holding capacity of said application means for said cosmetic product or to increase the flexibility of said axial projection.

17. Applicator according to claim 1 in which the number N of elements $E_i$ ranges from 12 to 24.

18. Applicator according to claim 1 in which said stack has a height H which typically varies from 10 mm to 50 mm, said height H corresponding to the sum of the axial thicknesses $E_c$ of said central parts $C_i$, said height H being equal to the product $N.E_c$ when said central parts $C_i$ have identical axial thicknesses $E_c$.

19. Applicator according to claim 1 in which said elements E are composed of plastic material formed by one of molding and machining.

20. Applicator according to claim 1 in which said axial core and said axial rod constitute a molded rigid member of plastic material, the junction between said rod and said axial core defining a shoulder constituting an upper abutment for the first element $E_1$ of said stack, so as to define an upper part of said axial assembling means.

21. Applicator according to claim 1 in which said axial core is provided at its lower end with a so-called lower abutment for said last element $E_N$, said lower abutment comprising a radial member allowing an axial irreversible snapping of said stack over said axial core, so as to define a lower part of said axial assembling means.

22. Applicator according to claim 1 in which said axial core comprises a coupling handle member at its upper part, said coupling handle member cooperating with a blind hole of said axial rod at its lower end, said axial core forming at its lower end a lower abutment for said last element $E_N$, said lower abutment comprising a radial member defining a lower abutment or stop for said stack.

23. Applicator according to claim 1 in which said element E is an asymmetrical element E' lacking symmetry with respect to a transverse plane, such that so flipping element E' with respect to said axial direction results in an element $E'_R$ which is not superposable over said element E'.

24. Applicator according to claim 1 in which said stack is a stack in which two consecutive elements are separated by an intermediate member I, said intermediate member having a transverse cross-section that is related to the transverse cross-section of said central part of said elements.

25. Applicator according to claim 24 in which said intermediate member I is an axially compressible member.

26. Dispenser applicator comprising an applicator according to claim 1, and a body defining a container for said cosmetic product, said body comprising a neck with a wiper for said application means, said prehension means of said applicator defining a cap adapted to cooperate by screwing with said neck so as to form a seal.

27. Applicator assembly comprising an applicator for a cosmetic product comprising:

d) a prehension means defining a cap for a container adapted to contain said cosmetic product, e) an axial rod, f) means for applying said cosmetic product, said axial rod being unitary with said prehension means at its upper end, and with said applying means at its lower end, in which said applying means comprises:

(i) an axial core which is unitary with said axial rod at its lower end, and (ii) a stack of a plurality of N elements, each element being a molded or machined single piece of material and comprising a central orifice for housing said axial core allowing said axial core to pass therethrough and at least a projection, said stack being axially fixed to said axial core through an axial assembling means, wherein said axial core and said plurality of elements E cooperate with a means for angularly orienting said elements E with respect to said axial rod in a transverse plane perpendicular to said axial rod, so that each element $E_i$ of rank i in said stack, wherein i ranges from 1 to N, is unitary in rotation with said axial core and provides a predetermined angular orientation $\alpha_i$ with respect to said axial core; and at least another plurality of elements E', said means for axially assembling said applicator comprising said stack of elements E, the stack of elements being a reversible axially assembling means configured to permit replacement of at least part of said stack E by at least part of said stack E', said stack E' being distinct from said stack E.

28. An applicator for a cosmetic product comprising:

a container and a cap configured to retain a cosmetic product;

an axial rod extending from the cap, an outer surface of the axial rod comprising a plurality of exterior ribs and grooves arranged to form an axial rod cross-sectional shape; and a plurality of brush elements, each of the plurality of brush elements including a central part having a cut-out and a plurality of projections extending in a radial direction from the central part toward a perimeter of the brush element, the cut-out including a plurality of interior ribs and grooves sized and shaped such that the cut-out has a shape complimentary to the axial rod cross-sectional shape;

wherein the plurality of brush elements are supported and axially aligned on the axial rod, with the axial rod extending through the cut-out of each of the brush elements wherein at least two projections of each of the brush elements extend in radial direction and upward above a plane transverse to the axial rod and at least two projections of the brush element extend in a radial direction and downward below the plane transverse to the axial rod;

wherein the at least two projections of each of the brush elements that extend in radial direction and upward above a plane transverse to the axial rod are arranged on a first half side of the brush element and wherein the at least two projections of the brush element that extend in a radial direction and downward below the plane transverse to the axial rod are arranged on an opposing second half side of the brush element, the first and second half sides of the plurality of brush elements being axially aligned.

* * * * *